US005533714A

United States Patent [19]

St. John

[11] Patent Number: 5,533,714

[45] Date of Patent: Jul. 9, 1996

[54] MODULAR FENCE APPARATUS

[76] Inventor: Ross St. John, Government Road & William Street, Collacott Subdivision, Yorton, SK, Canada, S3N 2X5

[21] Appl. No.: 364,822

[22] Filed: Dec. 27, 1994

[51] Int. Cl.[6] ..... E04H 17/16

[52] U.S. Cl. ..... 256/26; 256/24; 256/73

[58] Field of Search ..... 256/24, 25, 26, 256/31, DIG. 2, 73, 59, 60, 64; 49/58; 119/840

[56] References Cited

U.S. PATENT DOCUMENTS

| | | | |
|---|---|---|---|
| 529,067 | 11/1894 | Fraser | 256/24 |
| 741,650 | 10/1903 | Frey | 256/31 X |
| 1,214,705 | 2/1917 | Neely | 256/31 |
| 2,855,183 | 10/1958 | Moore | 256/26 |

FOREIGN PATENT DOCUMENTS

| | | | |
|---|---|---|---|
| 1091968 | 12/1980 | Canada . | |
| 2031200 | 1/1971 | Germany | 256/26 |

*Primary Examiner*—Anthony Knight

[57] ABSTRACT

This invention relates to fence apparatus that is constructed from modular assemblies which permit compact transport of the fence from the manufacturer to the field where set up and assembly of the modular elements may be quickly and effectively made into a perimeter fence to prevent entry of animals and bovine into the area fenced.

14 Claims, 3 Drawing Sheets

MODULAR FENCE APPARATUS

BACKGROUND OF THE INVENTION

This invention relates to apparatus for construction of a fence in particular to a modular fence assembly which is compact for transport and provides reusable fence elements that may be readily reconfigured to adapt to the requirements of the area to be fenced.

SUMMARY OF THE INVENTION

A general object of this invention is to provide a modular fencing system that provides minimal basic working assemblies that can be interchangeably connected to provide a fence enclosure for protection of buildings and machinery from animal contact, particularly bovines.

It is a further object of this invention to provide a modular fencing system that is comprised of basic working assemblies that can be compactly arranged and stacked to permit the maximum amount of fencing structure to be placed on a vehicle for transport from the manufacturer to vendors for sale or the field for installation.

It is yet another object of this invention to provide a modular fencing system that can be quickly assembled in the field with simple, commonly available hand tools.

In one of its aspects the invention provides: a modular fencing system comprising: a panel assembly having a plurality of longitudinal span members spacedly deposed substantially parallel to each other affixed at each respective end thereof to transverse panel ends defining a substantially planar surface; a corner assembly having an inner support post of one length and two outer support of equal length different from said inner support post, two longitudinal panel mount elements each one connecting the top of the inner support post with the top of a corresponding outer support post and a plurality of longitudinal span members spacedly deposed and extending between said panel mounts whereby a predetermined angle is provided between said panel mounts and a substantially triangular planar surface inclined at a predetermined angle is defined by said panel mount elements and said plurality of longitudinal span members extending therebetween; a joiner assembly provided with an inner support post and a shorter outer support post and a panel mount connecting the top of the inner support post with the top of the outer support post defining a predetermined incline angle equal to that angle of inclination of the substantially triangular planar surface of said corner assembly; fastener means to securely fasten said panel ends to said panel mounts; whereby a fence enclosure can be constructed from a plurality of said panel assemblies fastened by said fastener means to corner assemblies and joiner assemblies.

BRIEF DESCRIPTION OF THE DRAWINGS

A detailed description of the preferred embodiment of the invention now follows with reference to the drawings in which.

DESCRIPTION OF THE PREFERRED EMBODIMENT

Figure 1:
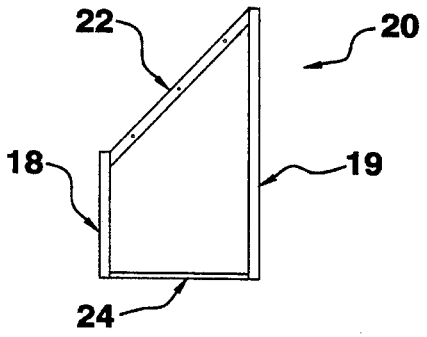
FIG. 1 is an exploded elevation view of a portion of a fence comprised of modular elements constructed in accordance with the present invention
Figure 1:
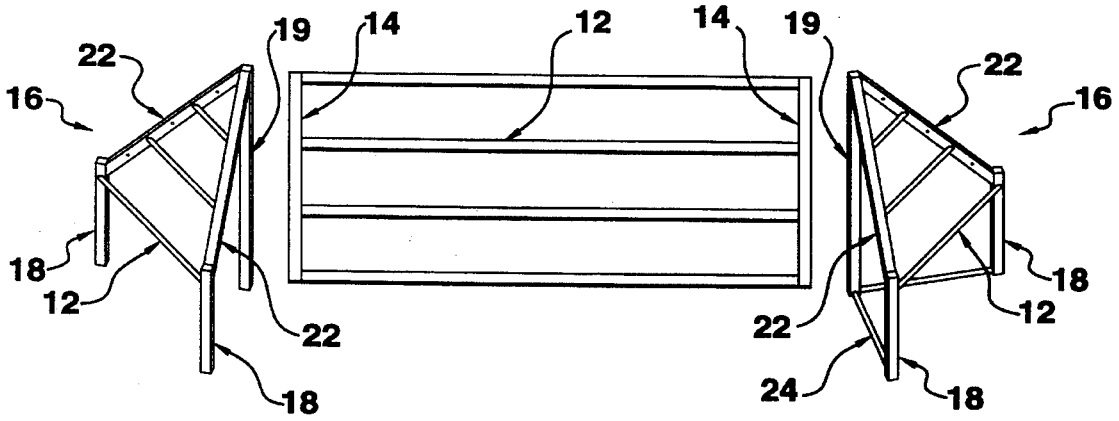

A detailed description of the preferred embodiment of the invention together with useful variations thereof now follows with reference to like features of the invention bearing the same reference numerals in the Figures throughout.

Referring now to FIG. 1 which shows an exploded view of a portion of a fence comprised of modular elements constructed in accordance with the present invention. Each of the modular elements of the fencing system described herein is constructed to provide a fence structure to be deployed in a field around an item, such as a well, pump station or the like, sought to be isolated from larger animals such as moose, elk or particularly bovines.

An outside corner assembly 16 is shown having 2 shorter outer support posts 18 and a single longer inner support post 19. Extending between the top of the inner and outer support posts is a panel mount 22. Extending between each panel mount is a plurality of span members 12. The configuration of the corner assemblies is provided to enable these assemblies to be stacked one upon the other to facilitate a number of these assemblies to be transported in a compact stack from the factory to the field where the fencing system will be deployed. The manner of stacking the corner assemblies is shown and described in more detail with reference to FIGS. 3*a* and 3*b*. To provide relative stability and sturdy construction of the corner assemblies, an optional ground runner member 24 may be incorporated into the corner assembly extending between the lower portion of inner support post 19 and each outer support post 18. In providing ground runners in the corner assemblies, it should be noted that it is not desirable to provide a ground runner extending between the lower portions of outer support posts 18 as that prevents stacking of the corner assemblies when substantially vertical support posts 18 and 19 are employed. Should the need to have a ground runner 24 extend between outer support posts 18 be desired, it is necessary to provide an incline of the support posts 18 and 19 to enable the assemblies to be stacked. A description of this manner of construction of the corner assemblies is made with reference to FIG. 3*b*.

Corner assemblies will commonly define a right angle between the panel mounts 22 to enable a square or rectangular area to be enclosed. Other angles may also be fabricated to allow flexibility in fencing system design and these other angles would likely include a 45 degree angle and a 22½ degree angle.

The difference in lengths between the outer post 18 and inner post 19 of the corner and joiner assemblies herein described is provided to incline the panel mount 22 to which typically a panel assembly 10 will be fastened (typically because frequently it will be a panel assembly that is fastened to the corner assemblies, but it is not a requirement that a panel assembly be fastened thereto, there could be fence configurations that require 2 corner assemblies to be attached). This difference in lengths provides an incline to the panel assemblies 10 which is useful in several important respects. Firstly the inclined fencing surface permits each fence supporting structure (whether a corner assembly 16 or 17, or a joiner assembly 20) to have 2 load bearing posts horizontally displaced for each panel end 14. By providing a horizontal displacement between these posts, the fence system can rest on the ground, thereby eliminating the need to drill post holes and other post mounting preparations yet provide a sturdy fence structure that is able to withstand vertical and horizontal loading caused by animals pressing against the fence system. Additionally, the inclined fence surface provides a vertical and horizontal fence obstacle to an animal making it difficult for the animal to jump over the fence.

Figure 4:
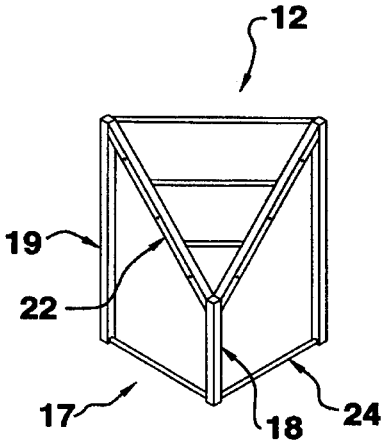
FIG. 4 is an elevation view of an inside corner assembly.

As may be appreciated, an inside corner assembly can equally well be constructed and such an assembly is described herein with reference to FIG. 4 in the drawings.

The modular fencing system of the subject invention is provided with panel assemblies 10 which are comprised of a plurality of span members 12 constructed from rigid material such as square or round piping or tubing. It is preferable to have the span members 12 constructed from a metal material such as iron having an outside dimension of 1¼ inches to 2 inches. Larger dimensions than 2" are not desirable as the resulting weight of the panel assembly is too heavy relative to the increase in strength associated with the larger material. Similarly, providing span members with materials having an outer dimension of less that 1¼ inches results in a weak and easily bendable span member which is not useful for fencing in accordance with the system of the present invention. To protect the metal from corrosion and the elements, a painted surface is applied as is common for metal structures. It is preferable to provide standard panel assembly lengths to permit any suitable length fence to be constructed using pre-fabricated lengths. Typical lengths include panel assemblies having a length of 7½, 10 and 12 feet. The 7½ foot length panel assembly is normally used in conjunction with a gate assembly which is described in more detail with reference to FIG. 7. Provided at each end of the panel assembly 10 is a panel end 14 which is constructed of a rigid material to maintain shape even under pressure from a bovine pressing against the span members connecting the panel ends. Panel assemblies 10 form a substantially planar surface and are therefore easily stackable for transport.

For a fence which has a run extending beyond the reach of a single panel assembly 10, there is provided a joiner assembly 20 to join two panel assemblies in a straight line run while supporting each panel assembly relative to the ground. The joiner assembly is fabricated with a shorter outer support post 18 and a longer inner support post having an inclined panel mount 22 extending therebetween. As with corner assemblies, ground runner 24 can be prodded at the base of the joiner assembly extending between the lower portion of outer support post 18 and lower portion of inner support post 19. The ground runner creates a stronger joiner assembly. Joiner assemblies 20 form a substantially planar surface and are therefore easily, compactly stackable for transport.

Figure 2A:
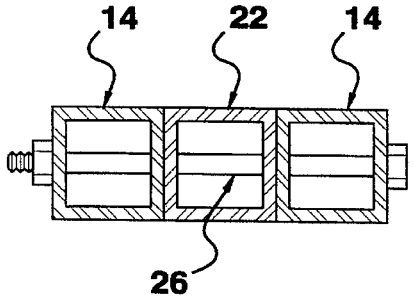
FIG. 2*a* is a cross section end view of the area of contact between the panel end and panel mount according to a first configuration of panel ends.

Referring to FIG. 2*a*, a cross section end view of the area of contact between the panel end and panel mount according to a first configuration of panel ends 14 is shown. In this configuration, panel end 14 is constructed from square tubing as shown which is placed beside panel mount 22 and is fastened thereto by means of a fastener 26 which is simply a bolt and nut extending through the elements to be fastened, namely a first panel end 14, panel mount 22 and a second panel end 14. At least 2 fasteners 26 should be provided along the contact area of the panel assembly with the panel mount 22.

Figure 2B:
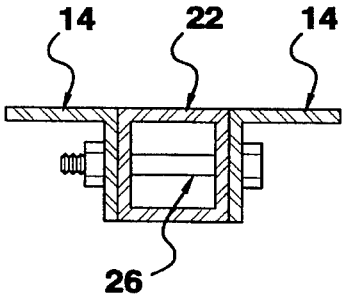
FIG. 2*b* is a cross section end view of the area of contact between the panel end and panel mount according to an alternate configuration of panel ends.

Referring to FIG. 2*b*, a cross section of the area of contact between the panel end and panel mount according to an alternate configuration of panel ends 14 is shown. In this configuration, a panel end 14 is constructed from angle iron and is fastened to panel mount 22 by means of a fastener 26. This could simply be a bolt and nut extending through the elements to be fastened, namely a first panel end 14, panel mount 22 and a second panel end 14. At least 2 fasteners 26 should be provided along the contact area of the panel assembly with the panel mount 22.

Figure 3A:
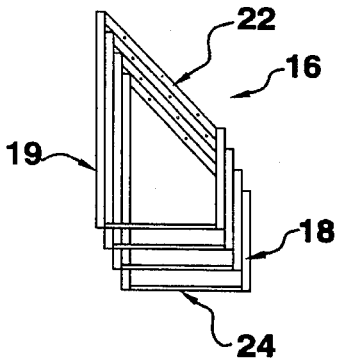
FIG. 3*a* is an elevation view of a plurality of outside corner assemblies stacked for transport.

Referring now to FIG. 3*a* there is shown an elevation view of a plurality of outside corner assemblies 16 stacked ready for transport. The horizontally inclined triangular surface defined by the pair of panel mounts 22 extending from the tops of inner support post 19 and the pair of outer support posts 18 mates with the same surface of a corner assembly positioned above or below a given corner assembly. As may be seen, each stacked corner assembly is off-set from the assembly below by the dimension of the material used to construct the assembly. Accordingly, stacking of the corner assemblies of this construction is limited to a stack height that remains stable and able to remain standing without falling over. It is possible to tie 2 mirror image opposing stacks together for transport to ensure stability for transport.

Figure 3B:
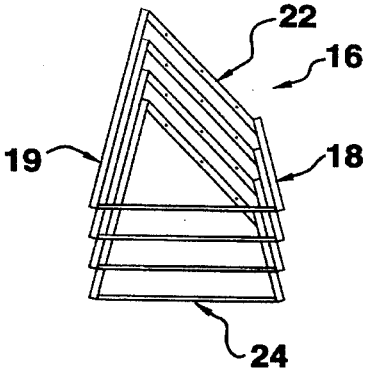
FIG. 3*b* is an elevation view of an alternate construction of corner assemblies stacked for transport.

In FIG. 3*b* there is shown an alternate construction of corner assemblies 16 wherein the support posts 18 and 19 are inclined from vertical by the post material dimensions (i.e. by 1¼"–2") to permit the corner assemblies to stack one upon the other. Stacking of the corner assemblies of this construction results in a stack that is vertical and therefore vertical heights of the corner assembly stacks created from corner assemblies as described with reference to FIG. 3*a* are potentially possible.

FIG. 4 illustrates an elevation view of an inside corner assembly wherein a single outer support post 18 and 2 inner support posts 19 are provided. The pair of panel mounts 22 extend from the top of outer support post 18 to the tops of inner support posts 19 having a plurality of span members extending therebetween in the same manner as an outside corner assembly described previously with reference to FIG. 1. Inside corner assemblies are stackable in the same manner as outside corner assemblies.

Figure 5:
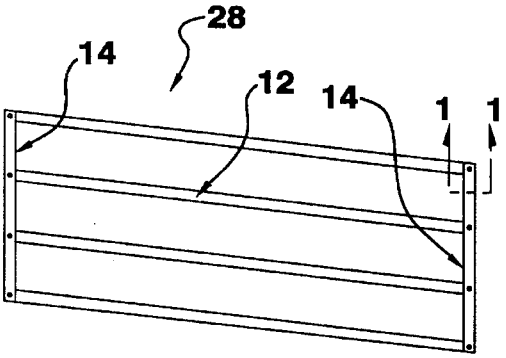
FIG. 5 is an elevation view of a rotatable parallelogram panel assembly.

Referring to FIG. 5, there is shown an elevation view of a rotatable parallelogram panel assembly 28 wherein each span member 12 is rotatably secured to the panel ends 14 to permit the entire panel to rotate as a parallelogram. Such a construction of the panel assembly is used where the ground surface upon which the fence is to be constructed is hilly and uneven. This frequently occurs, even for relatively small fence structures, where the fencing is to cross a spill berm around a fluid pump or a road allowance.

Figure 5A:
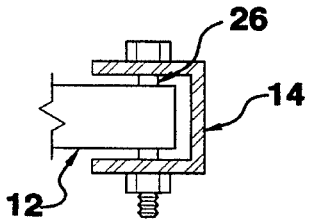
FIG. 5*a* shows a cross sectional view of an end portion of the parallelogram panel assembly of FIG. 5 taken along cutting line AA.

Referring to FIG. 5*a* which shows a cross sectional view of an end portion of the parallelogram panel assembly of FIG. 5 taken along cutting line AA. Span member 12 is placed into a panel end 14 formed from u-shaped channel iron. A hole is drilled through the panel end 14 and span member 12 and a fastener 26, being simply a bolt and nut is passed through the holes to fasten the span member 12 to the panel end yet permit free rotation between these two elements.

Figure 6:
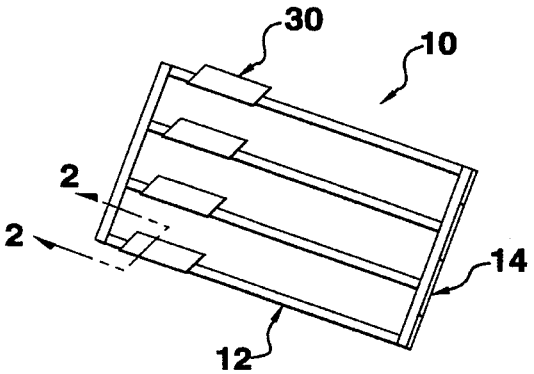
FIG. 6 is a perspective view of a panel assembly provided with stairs.

Referring to FIG. 6 there is shown a perspective view of a panel assembly provided with stairs. To permit entry into a fenced area, there are several options which are employed, the first of which is to provide stair treads 30 that are attachable to the span members 12.

Figure 6A:
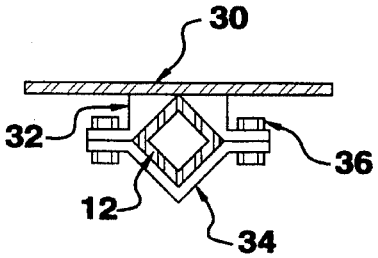

In FIG. 6*a*, there is shown a cross sectional view of the stair tread 30 mounted on span member 12 by means of a tread mounting jig 32 that is cut to fit over span member 12 and provide a substantially horizontally positioned stair tread 30 when the fence is erected. The stair tread 30 could be welded to the span member 12 or, as is shown, attached to the span member 12 by means of a clamp 34 which is bolted 36 to the tread mounting jig 32. Bolting the stair tread to the span members 12 is preferable to welding as the stair tread can then be mounted where desired in the field when the fence is being assembled and is moveable as needs change. Field mounting the stair tread permits the span member to remain substantially fiat for stacking in transport. If the stair tread is welded onto the span member, the welding must either be done in the factory, making transport less compact or a welding unit must be taken to the field which requires more than the simple wrench assembly in the field that bolting requires and field welding also requires touch-up painting to be done in the field to cover the metal exposed and paint discoloration occurring during the welding process.

Figure 7:
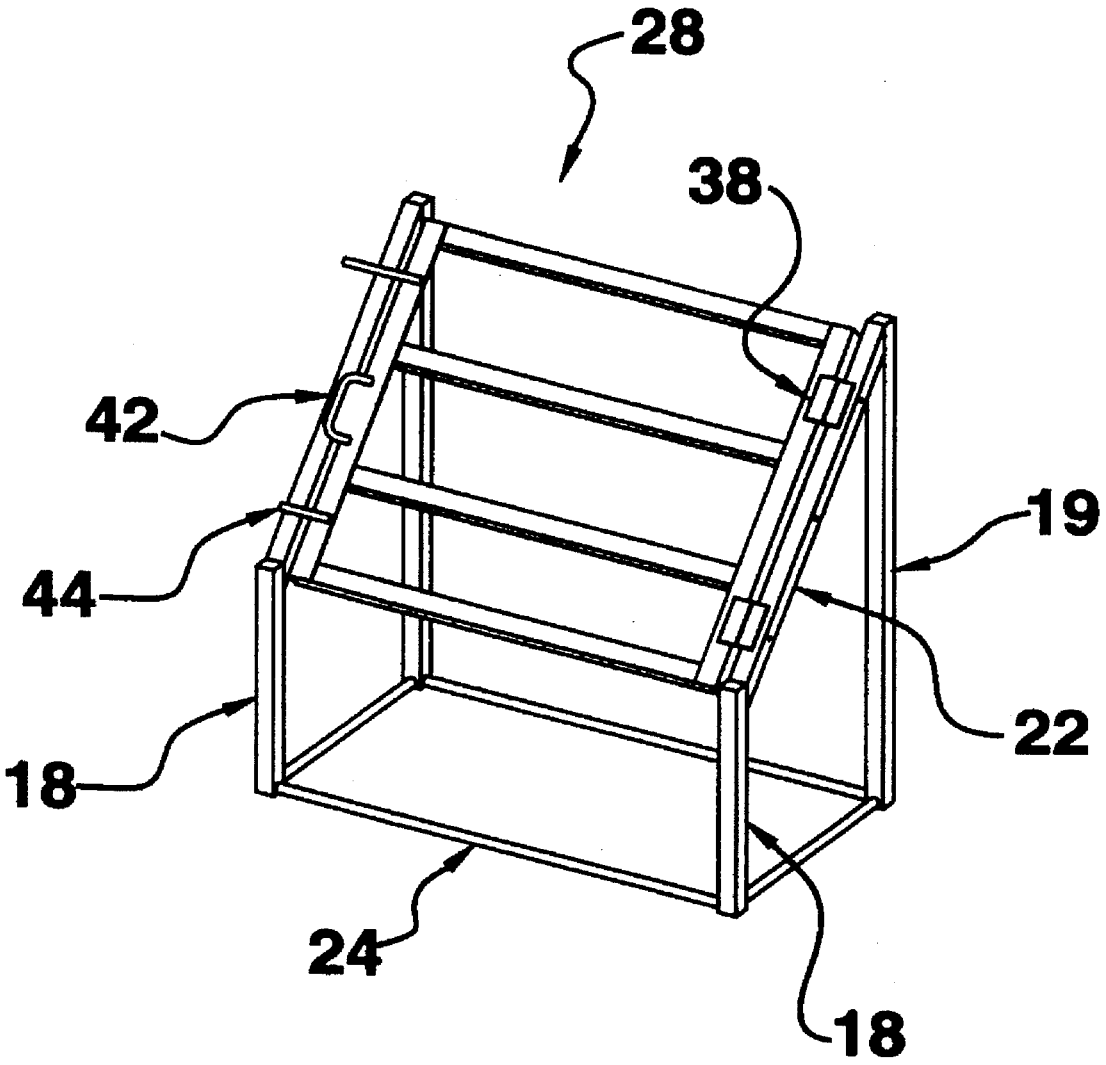
FIG. 7 is a perspective view of a gate assembly.

Referring now to FIG. 7 there is shown a perspective view of a gate assembly permitting an alternate means of entry into the area enclosed by a fence system of the present invention. The gate is provided with a panel mount 22 on either side thereof for interconnection to the fence system. The gate is supported by a pair of outer support posts 18 and inner support posts 19. One side of the gate is hinged with hinges 38 permitting the gate 40 to be opened by swinging upwardly open. For convenience a handle 42 may be provided on the gate. Extending between all of the post members 18 and 19 there may be provided a ground runner 24 which is there to connect the post members together making a gate unit. It can be appreciated that the gate assembly can be constructed from two joiner assemblies 20 of FIG. 1, by attaching hinges 38 to one joiner assembly and the gate 40 on the other side of gate 40, a gate rest 44 is provided to allow the gate to rest on the other joiner assembly when closed.

While the invention has been described in terms of the preferred embodiment, it should be clearly understood that the invention is subject to numerous modifications and mechanical equivalents which do not depart from its scope as defined by the claims appended hereto.

I claim:

1. A modular fencing apparatus comprising:

a) a panel assembly having a plurality of longitudinal span members spacedly disposed substantially parallel to each other, the ends of each span member being attached to respective panel ends to thus define a substantially planar surface;

(b) a corner assembly having an inner support post of one length and two outer support posts of equal length and of different length from said inner support post, two longitudinal panel mount elements each one connecting the top of the inner support post with the top of a corresponding outer support post, to create a predetermined angle, and a plurality of longitudinal span members spacedly disposed and extending between said panel mounts so that a substantially triangular planar surface inclined at said predetermined angle is formed; and (c) fastener means to securely fasten said panel ends to said panel mounts;

whereby a fence enclosure can be constructed from a plurality of said panel assemblies fastened to a corresponding plurality of corner assemblies.

2. Apparatus as claimed in claim 1 wherein the predetermined angle of inclination is approximately 10 to 80 degrees.

3. Apparatus as claimed in claim 1 or 2 wherein said longitudinal span members are rigidly affixed at each respective end thereof to said transverse panel ends to form a substantially rectangular planar surface.

4. Apparatus as claimed in claim 1 or 2 wherein said longitudinal span members are rotably affixed at each respective end thereof to said transverse panel ends to form a variable parallelogram planar surface.

5. Apparatus as claimed in claim 1 further including at least one stair tread element on one of said panel assemblies, said stair tread element being rigidly attached to said longitudinal span members.

6. Apparatus as claimed in claim 1 further including a gate assembly comprising a pair of inner support posts of equal length and a pair of outer support posts of equal length and of different length than that of the inner-support posts, each inner and outer support post connected at the top by a panel mount extending therebetween at an angle of inclination corresponding to the inclination angle of the triangular planar surface of said corner assembly, a substantially rectangular planar gate panel hingedly attached at one side to one of said panel mounts and including means for supporting the other side of said gate when in the closed position.

7. Apparatus as claimed in claim 6 further including ground runner members connecting the bottom portion of each said post of said gate assembly to maintain spaced alignment of said posts.

8. Apparatus as claimed in claim 1 further comprising a joiner assembly having two inner support posts of equal length and an outer support post of shorter length than said inner support posts, two panel mount elements connecting the tops of the inner support posts with the top of the outer support post, to form a predetermined angle, and a plurality of longitudinal span members spacedly disposed and extending between said panel mounts so that a substantially triangular planar surface inclined at said predetermined angle is formed.

9. Apparatus as claimed in claim 8 wherein the predetermined angle of inclination is approximately 10 to 80 degrees.

10. Apparatus as claimed in claim 8 wherein said longitudinal span members are rigidly affixed at each respective end thereof to said transverse panel ends to form a substantially rectangular planar surface.

11. Apparatus as claimed in claim 8 wherein said longitudinal span members are rotably affixed at each respective end thereof to said transverse panel ends to form a variable parallelogram planar surface.

12. Apparatus as claimed in claim 8 further including at least one stair tread element on one of said panel assemblies, said stair tread element being rigidly attached to said longitudinal span members.

13. Apparatus as claimed in claim 8 further including a gate assembly comprising a pair of inner support posts of equal length and a pair of outer support posts of equal length and of different length than that of the inner support posts, each inner and outer support post connected at the top by a panel mount extending therebetween at an angle of inclination corresponding to the inclination angle of the triangular planar surface of said corner assembly, a substantially rectangular planar gate panel hingedly attached at one side to one of said panel mounts and including means for supporting the other side of said gate when in the closed position.

14. Apparatus as claimed in claim 13 further including ground runner members connecting the bottom portion of each said post of said gate assembly to maintain spaced alignment of said posts.

* * * * *